US005950392A

United States Patent [19]

Short, V et al.

[11] Patent Number: 5,950,392

[45] Date of Patent: Sep. 14, 1999

[54] HINGED TRUSS

[75] Inventors: Jordan (Jay) P. Short, V; Jordan P. Short, IV, both of Tifton; Hal Hand, Douglas; Taylor Williamson, Camilla, all of Ga.

[73] Assignee: Short & Paulk Supply Co., Inc., Tifton, Ga.

[21] Appl. No.: 09/093,867

[22] Filed: Jun. 9, 1998

[51] Int. Cl.[6] ..... E04C 3/02; E04B 1/343; E04B 1/32

[52] U.S. Cl. ..... 52/690; 52/92.2; 52/92.3; 52/93.1; 52/641; 52/645

[58] Field of Search ..... 52/92.2, 92.3, 52/93.1, 640, 641, 645, 646

[56] References Cited

U.S. PATENT DOCUMENTS

| | | | |
|---|---|---|---|
| 1,787,167 | 12/1930 | Purdy | 52/92.2 X |
| 2,350,904 | 6/1944 | King | 52/93.1 X |
| 3,414,300 | 12/1968 | Spane | 52/93.1 X |
| 3,423,898 | 1/1969 | Tracy et al. | 52/92.2 X |
| 3,823,522 | 7/1974 | Jureit et al. | 52/645 X |
| 4,411,547 | 10/1983 | Johnson | 52/93.1 X |
| 4,449,335 | 5/1984 | Fahey | 52/92.2 |
| 4,831,807 | 5/1989 | Bolt | 52/641 |

FOREIGN PATENT DOCUMENTS

| | | | |
|---|---|---|---|
| 448289 | 6/1936 | United Kingdom | 52/465 |

*Primary Examiner*—Christopher T. Kent
*Assistant Examiner*—Brian E. Giessner
*Attorney, Agent, or Firm*—John S. Pratt; Geoff L. Sutcliffe; Kilpatrick Stockton LLP

[57] ABSTRACT

Truss elements of a structure that are prefabricated, but hinged so that trusses may be reduced in size for transportation and storage. The hinge is made up of a sheet of flexible material which is affixed to elements of the truss by press fit plates. This press fit hinge can be installed on the truss simultaneously with the other press fit plates used to construct the truss, thereby dramatically reducing the number of steps required to construct the truss while still providing the desired feature of the hinge.

17 Claims, 6 Drawing Sheets

FIG. 6
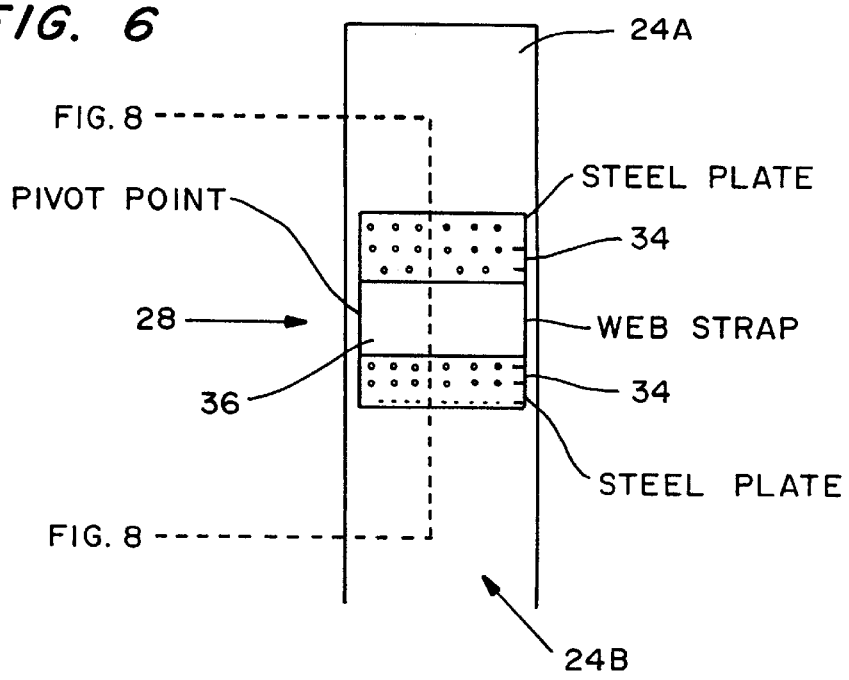
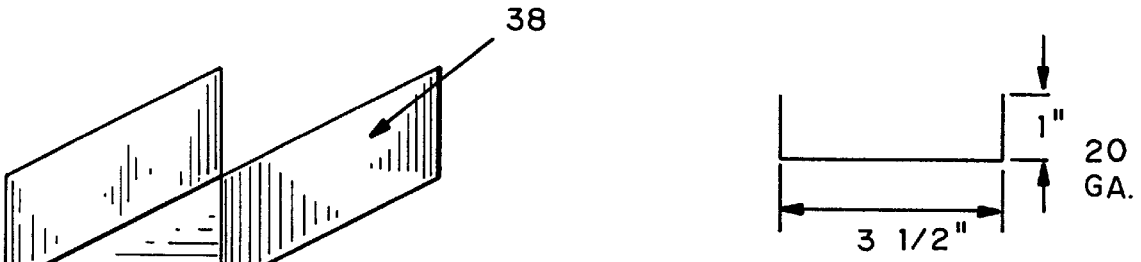
FIG. 7
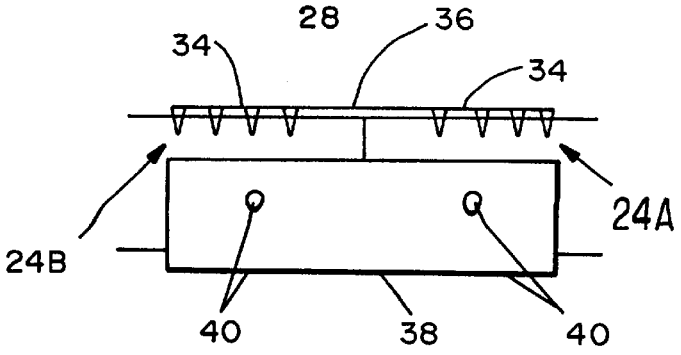
FIG. 8

HINGED TRUSS

BACKGROUND OF THE INVENTION

Small structures are often used as outlying buildings to homes, farms, factories and other larger structures for a variety of uses, such as storage of materials, garden supplies and machinery, among other things. In particular, homeowners often desire a garden or storage shed in which to store garden implements such as lawnmowers, etc. Such structures are typically very simple, such as shed 10 shown in FIG. 1. Because of the large volume of such structures, however, it is often desirable to construct the structure at the location where it is to be used. Thus, manufacturers of such structures often provide the structures in kit form to allow the user to build the structure in the desired location.

Typically, as illustrated in FIG. 2, kits for constructing a shed 10 will include some form of foundation 12 and a plurality of prefabricated trusses 14. The user positions foundation elements 12 and then erects trusses 14 across the foundation. Shed 10 is finished by adding siding and roof. One reason for prefabricating trusses is their relative complexity, as can be seen in FIG. 2. The complexity of trusses 14 arises from the number of pieces used to construct them, their geometry and the precision required in assembling the various elements to ensure the appropriate shape and consistency from truss to truss.

One drawback to prefabricated trusses, however, is that the prefabricated truss must be at least the size of the cross-section of the structure. Thus, while many of the elements of the kit may be reduced to a manageable size, the truss must be provided in its full and assembled state, which may be significantly larger than what may be easily transported or provided in a single package. For example, if the shed shown in FIG. 1 has dimensions of 8'×8'×8', trusses 14 must be at least 8'×8' if pre-assembled. In contrast, all the other elements of the structure, such as siding, roofing panels and various other structural supports may be sized to fit on a single 4'×8' pallet, i.e., a standard sized pallet that is easily shipped and handled by shippers, warehousers, distributors and retailers. The 8'×8' trusses, on the other hand, exceed the standard pallet size and thus cannot be packaged on the same pallet as the other materials. Thus, a kit for such a structure will necessarily include at least two pallets, one of which is oversized to accommodate the trusses. This complicates the transportation, storage, distribution and retailing of such structures, dramatically increasing the cost of such structures to the consumer, as well as creating great inconvenience in transporting the structure to the consumer's construction site.

Alternatively, the truss may be provided in partially assembled form. Nonetheless, such a partially assembled truss still creates the need for the user to assemble the truss with sufficient precision to ensure that the resulting structure is stable and consistent from truss to truss. Thus, it would be desirable to provide a kit for constructing structures which does not require precise assembly of truss elements, but that may be packaged on a single pallet of a standard size for ease of transportation, distribution, retailing and construction.

SUMMARY OF THE INVENTION

The present invention is a kit for constructing a small structure in which the truss elements of the structure are prefabricated, but hinged so that they may be reduced in size for transportation and storage. The hinge is made up of a sheet of flexible material which is affixed to elements of the truss by press fit plates. This press fit hinge can be installed on the truss simultaneously with the other press fit plates used to construct the truss, thereby dramatically reducing the number of steps required to construct the truss while still providing the desired feature of the hinge. Other types of hinges such recessed pin hinges may be used.

A truss so hinged may be folded in half so that it will fit on a conventional 4'×8' pallet along with all of the other materials for constructing the structure. When assembling the structure, the user merely unfolds the truss and affixes a brace to the truss which stabilizes the hinge and carries the load between the two truss segments. Thus, the present invention allows kits for such structure to be transported in a single standard size pallet, thereby dramatically reducing the costs and other complexities typically associated with transporting and marketing such kits, while still allowing prefabrication of the complex structure of the truss.

The hinge and assembly method for constructing the hinge may be used in larger or more complex trusses used in large structures such as houses and other buildings, thereby allowing such trusses to be prefabricated and transported without exceeding the size limitations typically placed on transportable loads.

Accordingly, it is an object of the present invention to provide a hinge to allow the folding of structural trusses.

It is a further object of the invention to provide a hinge for making foldable trusses which may be installed simultaneously with other press fit fasteners used to construct the truss.

It is a further object of the invention to provide a prefabricated kit for constructing small structures which may be transported in a single pallet of standard size.

Yet another object of the present invention is to provide a kit for constructing a structure which may be easily transported on a standard pallet, but that requires little precision or skill in assembling the truss element of the structure.

Other objects, features, and advantages of the present invention will become apparent with reference to the remainder of the written portion and the drawings of this application, which are intended to exemplify and not to limit the invention.

BRIEF DESCRIPTION OF THE DRAWINGS

FIG. 6 is a plan view of the hinge of the truss of FIG. 3.

FIG. 7 is a perspective view of a locking mechanism for use with the truss of FIG. 3

FIG. 8 is a cross section of the hinge of FIG. 6 taken along line 8—8.

DETAILED DESCRIPTION

Figure 1:
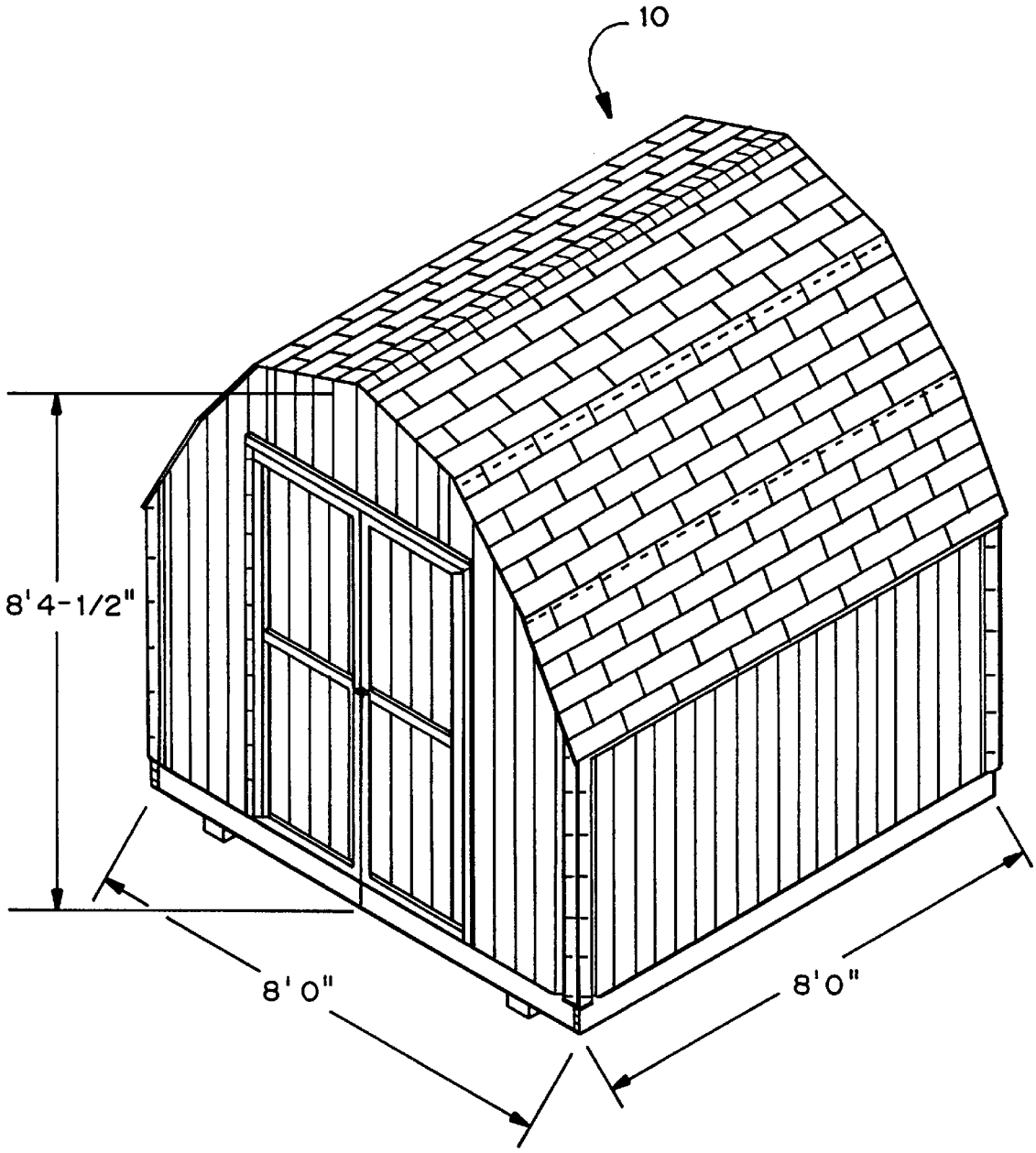
FIG. 1 is a perspective view of a structure of the prior art.
Figure 2:
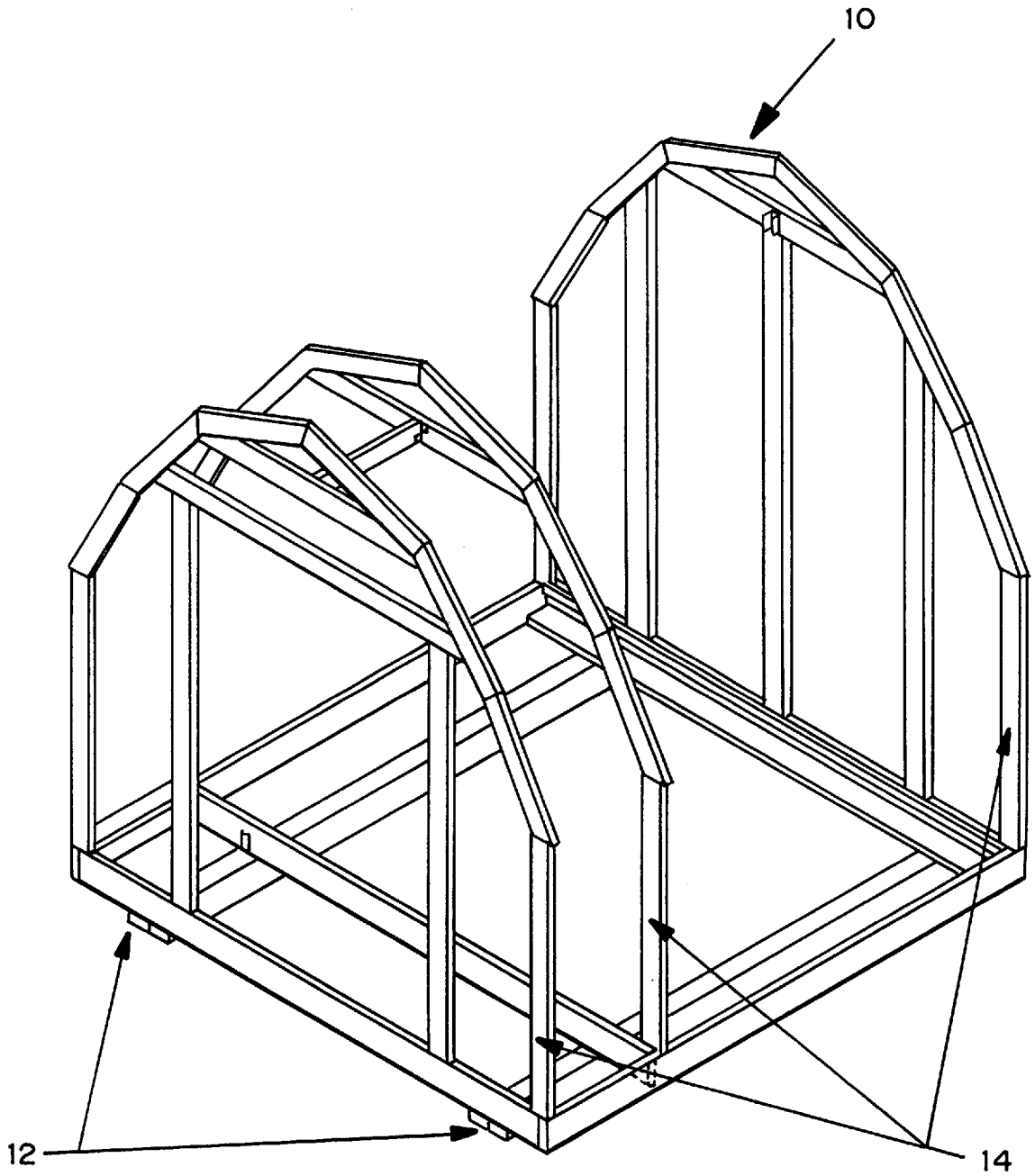
FIG. 2 is a perspective view of structure of FIG. 1, shown partially assembled.
Figure 3:
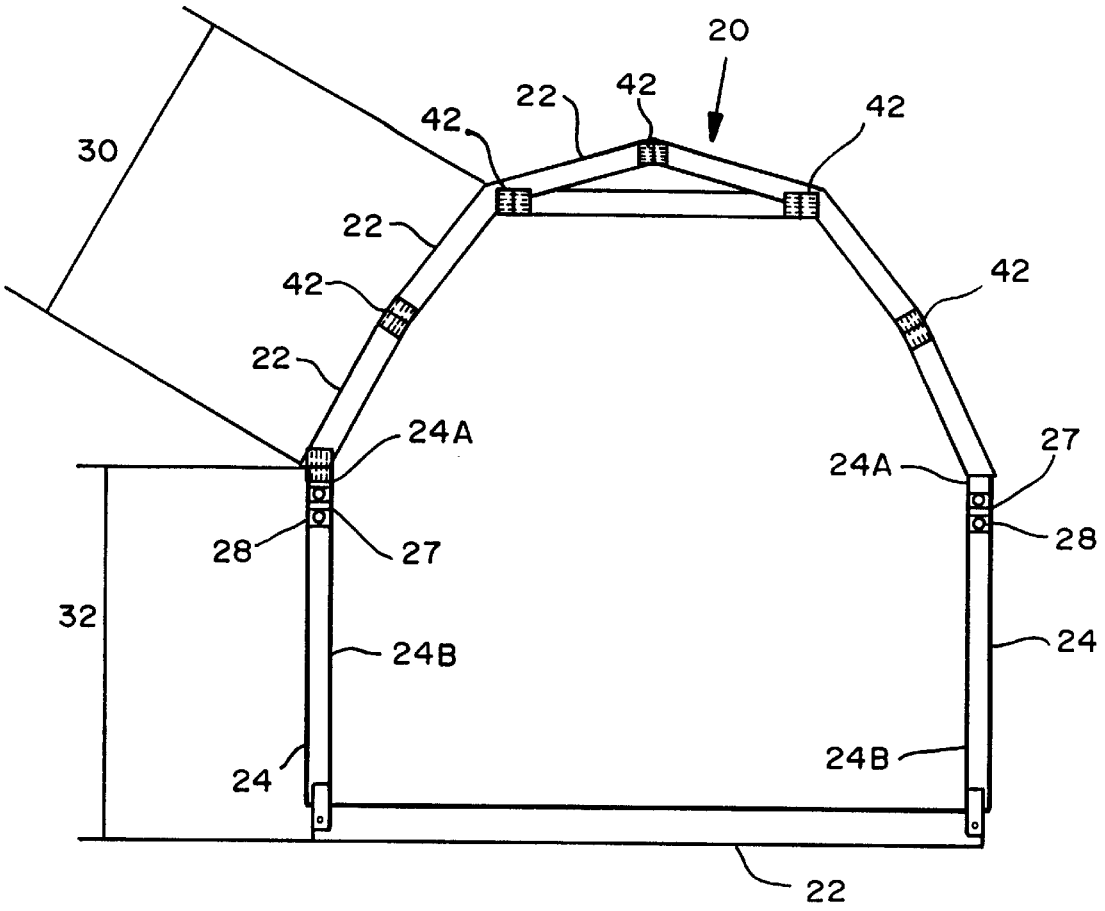
FIG. 3 is a plan view of a truss in accordance with the present invention.
Figure 4:
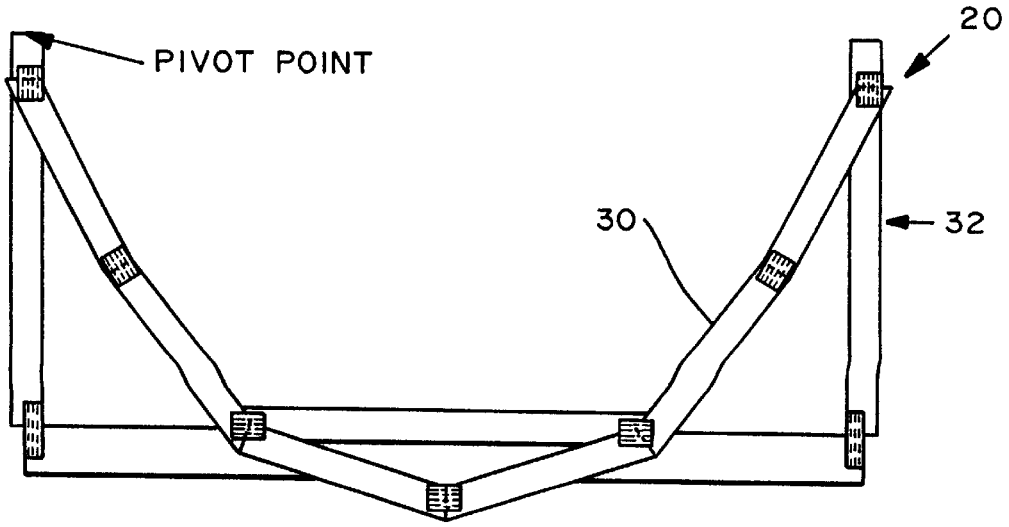
FIG. 4 is a plan view of the truss of FIG. 3 shown in the folded position.
Figure 5:
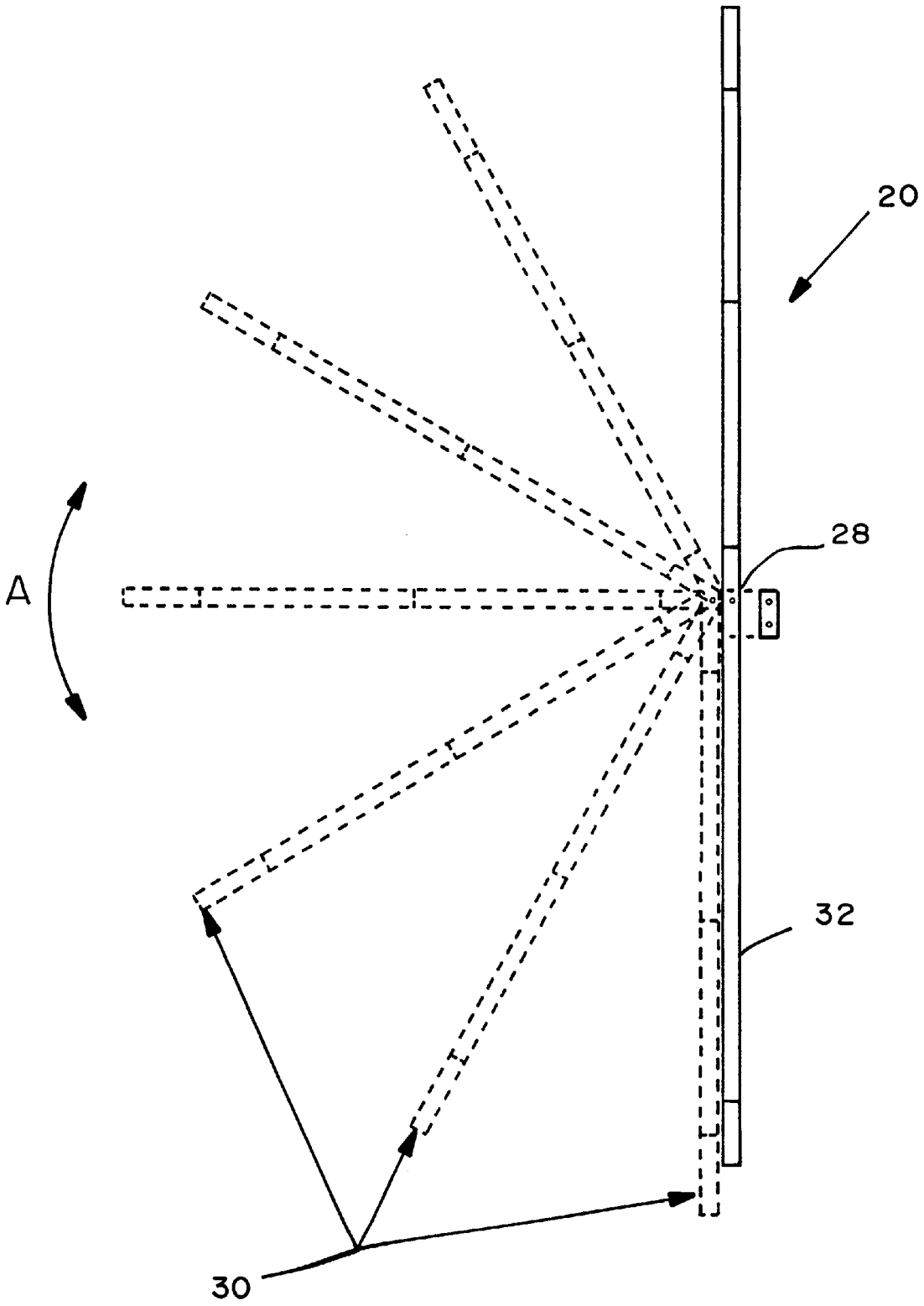
FIG. 5 is a side view of the truss of FIG. 3 shown in the folded position with the range of motion of the foldable portion of the truss shown in ghosted lines.

FIG. 3 illustrates a hinged truss 20 in accordance with the present invention. Truss 20 may be any truss structure made up of truss elements 22, including upright truss elements 24. Truss 20 may be constructed of wood or any other appropriate building material. Upright truss elements 24 are divided at an intermediate point (the "pivot point" 27) along their length and hinge 28 is provided to join the segments 24A and 24B. Thus, as further shown in FIGS. 4 and 5, truss is divided into top portion 30 and bottom portion 32, which pivot with respect to each other so that truss 20 may be folded into a compact size without the need for disassembling any of the elements 22 of truss 20.

FIGS. 6–8 show a first embodiment of hinge 28. Hinge 28 includes two press fit plates 34 and hinge strap 36. Press fit plates 34 are relatively rigid, toothed plates which may be made of steel, aluminum, or any other appropriate material. For example, conventional press fit plates typically used to assemble trusses and other structural components of buildings may be used. Hinge strap 36 is a woven nylon fabric strapping or any other strong flexible material. For example, hinge strap 36 may be made from the nylon strapping typically used to secure loads on trucks. Hinge strap 36 is positioned between press plates 34 and truss segments 24A and 24B so that the teeth of plates 34 extend through hinge strap 36 and into truss segments 24A and 24B. In this manner, plates 34 firmly secure hinge strap 36 across the divide between segments 24, thereby forming a hinge which allows segments 24A and 24B to rotate with respect to each other as indicated by arrow A as shown FIG. 5.

Referring to FIGS. 7 and 8, channel 38 is provided to secure segments 24A and 24B in a fixed position when truss 20 is unfolded for assembly of the desired structure. Channel 38 is a strong, rigid "C"-shaped channel which may be made of steel, aluminum or any other appropriate material. Other means for securing segments 24A and 24B also may be used. For example, rigid plates may be affixed across pivot point 27 and to one or more sides of segments 24A and 24B. Likewise, any other suitable means for securing segment 24A with respect to 24B and capable of bearing loads transferred there between may be used. Channel 38 is positioned across the divide between segments 24 of truss 20, on the side opposite hinge 28 and affixed to segments 24 with nails, screws, glue or any other appropriate fastener 48. Once affixed to segments 24, channel 38 bears all loads directed through segments 24, thereby providing a stable, rigid structure of about equal or greater strength than an uninterrupted truss element, or at least of a strength sufficient to provide the desired structural integrity of the completed truss 20.

Figure 9:
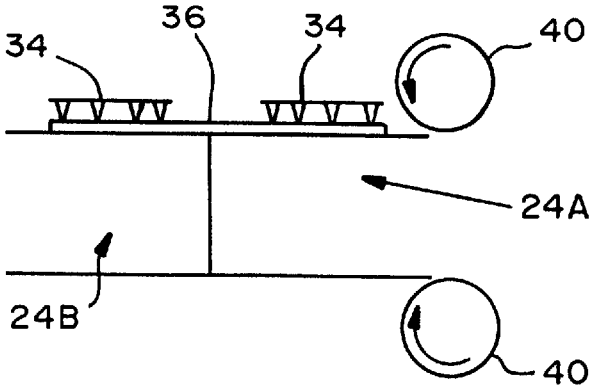
FIG. 9 is a side view of the hinge of FIG. 6 shown prior to assembly.
Figure 10:
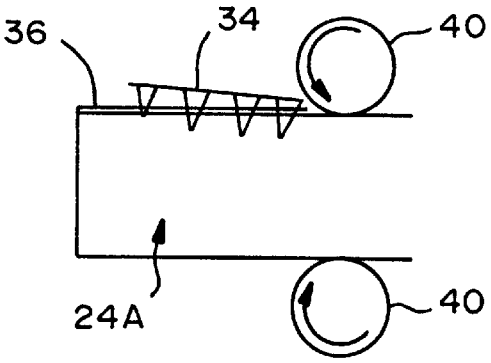
FIG. 10 is a side view of the hinge of FIG. 6 shown during assembly.

FIGS. 9 and 10 illustrate a method for assembling hinge 28. The various components of hinge 28, i.e., plates 34 and strap 36, are positioned in the appropriate locations along truss elements 24. The components and truss elements 24 are then directed through a press fitting machine or roller press 40. The rollers of roller press 40 engage the plates 34 and drive them through strap 36 and into truss elements 24. Roller press 40 may be any mechanism for driving plates 34 through strap 36 and into elements 24.

Conventional roller press devices which apply forces of about 30,000 to 80,000 psi and are used to assemble trusses by joining truss elements using press fit plates are suitable for assembling hinges 28. The ability to assemble hinges 28 using convention roller presses is advantageous as it allow a truss 20 to be completely assembled in one operation. For example, unassembled truss 20 may be laid out on a conventional roller press with joints between all elements bridged by conventional press fit plates 42. Pivot point 27 is bridged by the components of hinge 28, as described above. The entire assembly is then passed through the conventional roller press, thereby driving plates 34 and 42 into the truss elements 22 and 24, resulting in a fully assembled truss 20.

Figure 11:
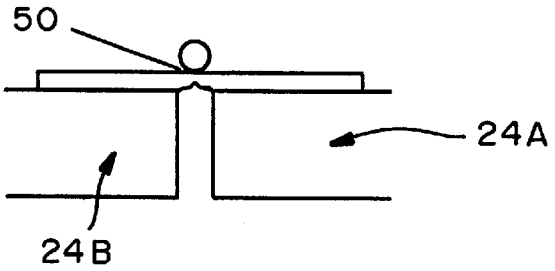
FIG. 11 is a partial side view of a first alternate embodiment of a hinged truss in accordance with the present invention.
Figure 12:
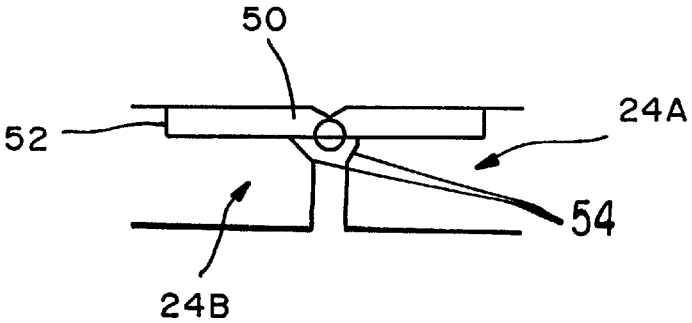
FIG. 12 is a partial side view of a second alternate embodiment of a hinged truss in accordance with the present invention.

FIGS. 11 and 12 illustrate alternate embodiments of hinge 50 in accordance with the present invention. Hinge 50 may be any hinge, including pin hinges or any other structure using rigid plates joined by some form of mechanical pivot. Such a hinge will provide all of the desirable characteristics of the truss 20 described above. Other hinges using soft or flexible materials also may be used.

As shown in FIG. 11, hinge 50 may simply be fastened to truss elements 24, bridging the gap there between. Because hinge 50 is rigid and protrudes above the surface of elements 24, it may not pass through a roller press without the risk of damage to the hinge 50 or the roller press. Thus, to assemble a truss using hinge 50, an entire truss 20 may be pre-assembled using a roller press, or other construction techniques and then later cut at pivot point 27 and hinges 50 applied. Alternatively, hinge 50 may be recessed in a dado 52 as shown in FIG. 12 or rabbet, thereby reducing the profile of hinge 50 so that it may pass through a roller press without damage to the hinge 50 or the roller press. It may be necessary to trim corners 54 of elements 24 in order to permit the desired freedom of movement between elements 24 when hinge 50 is in use.

Trusses 20 may be used to package, distribute and assemble structures in a convenient and efficient manner. Because trusses 20 may be folded as described above, they may be packaged with siding, roofing and other finishing materials on a single appropriately sized pallet. For example, all of the building materials may be packaged on a single 4'×8' pallet that can be stored and transported via conventionally available means without special accommodations, such as oversized trailers or storage areas. When the pallet is delivered to the user, the user simply unfolds trusses 20 and applies channels 38 to hinges 28, thereby stabilizing the pivot. Trusses 20 are then raised and affixed to the foundation and the structure is assembled as described above with respect to conventional structures.

As those skilled in the art will appreciate, the particular embodiments of this invention described above and illustrated in the figures is provided for explaining the invention, and various alterations may be made in the structure and materials of the illustrated embodiments without departing from the spirit and scope of the invention as described above and defined in the following claims.

We claim:

1. A truss for use in assembling a structure, the truss comprising:

a truss section that spans across a width of the truss, the truss section forming one of a top portion or a bottom portion of the truss;

a first upright truss element connected to a first part of the truss section;

a second upright truss element connected to a second part of the truss section;

the first and second upright truss elements being intended to extend along at least part of a height of the truss and each of the first and second upright truss elements comprising:

a first segment securely connected to the truss section;

a second segment; and a hinge secured between the first segment and the second segment;

wherein the hinges permit the truss section to pivot relative to the second segments in a direction transverse to both the width and height of the truss and permit the truss section to be placed adjacent the second segments of the first and second upright truss elements.

2. The truss of claim 1 wherein each hinge comprises:

a first press fit plate connected to the first segment;

a second press fit plate connected to the second segment; and a hinge strap secured between the first and second press fit plates.

3. The truss of claim 1 wherein each hinge is positioned in recesses defined in the first and second segments.

4. The truss of claim 1 further comprising a rigid member for being fastened between the first and second segments.

5. The truss of claim 4 in which the rigid member is a channel.

6. The truss as set forth in claim 1, wherein each of the hinges includes:

a first plate secured to the first segment;

a second plate secured to the second segment; and a mechanical pivot formed between the first and second plates.

7. The truss as set forth in claim 1, wherein each hinge is a pin hinge.

8. The truss as set forth in claim 1, wherein the first and second segments and the truss section are sized so that, when the truss section and the first segments pivot about the hinges and are placed adjacent the second segments, the truss fits on a pallet no larger than 4 feet by 8 feet.

9. The truss as set forth in claim 2, wherein the hinge strap is a flexible strap permitting the truss section to pivot 180 degrees relative to the second segments.

10. A kit for use in building a structure, the kit including a truss comprising:

a truss section that spans across a width of the truss, the truss section forming one of a top portion or a bottom portion of the truss;

a first upright truss element connected to a first part of the truss section;

a second upright truss element connected to a second part of the truss section;

the first and second upright truss elements being intended to extend along at least part of a height of the truss and each of the first and second upright truss elements comprising:

a first segment securely connected to the truss section;

a second segment; and a hinge secured between the first segment and the second segment;

wherein the hinges permit the truss section to pivot relative to the second segments in a direction transverse to both the width and height of the truss and permit the truss section to be placed adjacent the second segments of the first and second upright truss elements.

11. The kit as set forth in claim 10, further comprising a plurality of trusses.

12. The kit as set forth in claim 11, further comprising members for securing the first segments to the second segments.

13. The kit as set forth in claim 10, wherein the first and second segments and the truss section are sized so that, when the truss section and the first segments pivot about the hinges and are placed adjacent the second segments, the truss fits on a pallet no larger than 4 feet by 8 feet.

14. The kit as set forth in claim 10, further comprising materials for use in forming a roof of the structure.

15. The kit as set forth in claim 10, further comprising materials for use in forming a foundation of the structure.

16. The kit as set forth in claim 10, further comprising materials for use in forming sides of the structure.

17. The kit as set forth in claim 10, further comprising a plurality of trusses and also including materials for use in forming a roof, sides, and a foundation of the structure.

* * * * *